US009916792B2

(12) United States Patent
Yin

(10) Patent No.: US 9,916,792 B2
(45) Date of Patent: Mar. 13, 2018

(54) PIXEL DRIVING CIRCUIT AND DRIVING METHOD THEREOF AND DISPLAY APPARATUS

(71) Applicant: BOE TECHNOLOGY GROUP CO., LTD., Beijing (CN)

(72) Inventor: Jingwen Yin, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 19 days.

(21) Appl. No.: 15/026,783

(22) PCT Filed: Aug. 21, 2015

(86) PCT No.: PCT/CN2015/087759
§ 371 (c)(1),
(2) Date: Apr. 1, 2016

(87) PCT Pub. No.: WO2016/165257
PCT Pub. Date: Oct. 20, 2016

(65) Prior Publication Data

US 2017/0124956 A1 May 4, 2017

(30) Foreign Application Priority Data

Apr. 17, 2015 (CN) ..... 2015 1 0185647

(51) Int. Cl.
*G09G 3/32* (2016.01)
*G09G 3/3291* (2016.01)
*G09G 3/3225* (2016.01)

(52) U.S. Cl.
CPC ..... *G09G 3/3291* (2013.01); *G09G 3/3225* (2013.01); *G09G 2300/0426* (2013.01);
(Continued)

(58) Field of Classification Search
CPC ..... G09G 3/3291; G09G 3/3225; G09G 2300/0426; G09G 3/3258; G09G 3/3233; G09G 2300/0871; G09G 2310/08
See application file for complete search history.

(56) References Cited

U.S. PATENT DOCUMENTS 8,049,684 B2 11/2011 Kim
2009/0295422 A1 12/2009 Hamer et al.
(Continued)

FOREIGN PATENT DOCUMENTS

CN 1933688 A 3/2007
CN 102930818 A 2/2013
(Continued)

OTHER PUBLICATIONS

International Search Report of PCT/CN2015/087759 in Chinese, dated Jan. 25, 2016 with English translation.
(Continued)

*Primary Examiner* — Richard Hong
(74) *Attorney, Agent, or Firm* — Collard & Roe, P.C.

(57) ABSTRACT

There are disclosed a pixel driving circuit and a driving method thereof and a display apparatus. The pixel driving circuit comprises: a main driving unit (11) connected to a data line; a main light-emitting device (12) connected to the main driving unit; an auxiliary driving unit (13) connected to the main driving unit (11); and an auxiliary light-emitting device (14) connected to the auxiliary driving unit (13). Herein, in an acquisition phase, the main driving unit (11) is configured to discharge through the main light-emitting device (12), and the auxiliary driving unit (13) is configured to discharge through the main light-emitting device (12). In a data storage phase, the main driving unit (11) is configured to store a data voltage; and in a light-emitting phase, the main driving unit (11) is configured to drive the main light-emitting device (12) to emit light, and the auxiliary
(Continued)

driving unit (13) is configured to drive the auxiliary light-emitting device (14) to emit light. Since the auxiliary driving unit (13) can drive the auxiliary light-emitting device (14) to emit light in the light-emitting phase, brightness loss of the main light-emitting device (12) is remedied, so that brightness uniformity and brightness constancy of the display apparatus are raised.

19 Claims, 3 Drawing Sheets

(52) U.S. Cl.
CPC . *G09G 2300/0871* (2013.01); *G09G 2310/08* (2013.01); *G09G 2320/0233* (2013.01)

(56) References Cited

U.S. PATENT DOCUMENTS

2011/0050550 A1* 3/2011 Tsai ..... G09G 3/3233 345/76
2012/0306843 A1* 12/2012 Wang ..... G09G 3/3258 345/212
2014/0071027 A1 3/2014 Jin et al.
2015/0170565 A1* 6/2015 Hong ..... G09G 3/3233 345/212
2016/0196783 A1 7/2016 Hu et al.

FOREIGN PATENT DOCUMENTS

CN 103400545 A 11/2013
CN 103700346 A 4/2014
CN 104751801 A 7/2015

OTHER PUBLICATIONS

Notice of Transmittal of the International Search Report of PCT/CN2015/087759 in Chinese, dated Jan. 25, 2016.
Written Opinion of the International Searching Authority of PCT/CN2015/087759 in Chinese, dated Jan. 25, 2016 with English translation.
Second Chinese Office Action in Chinese Application No. 201510185647.0, dated Apr. 12, 2017 with English translation.
Chinese Office Action in Chinese Application No. 201510185647.0, dated Sep. 1, 2016 with English translation.

* cited by examiner

PIXEL DRIVING CIRCUIT AND DRIVING METHOD THEREOF AND DISPLAY APPARATUS

CROSS REFERENCE TO RELATED APPLICATIONS

This application is the National Stage of PCT/CN2015/087759 filed on Aug. 21, 2015, which claims priority under 35 U.S.C. § 119 of Chinese Application No. 201510185647.0 filed on Apr. 17, 2015, the disclosure of which is incorporated by reference.

TECHNICAL FIELD

The present disclosure relates to a pixel driving circuit and a driving method of the same and a display apparatus.

BACKGROUND

With the rapid progress of the multimedia society, the technologies of semiconductor elements and display apparatus have dramatic progress accordingly. In terms of the display apparatus, an active matrix organic light emitting diode (AMOLED) display device meets specification requirements for a display in multimedia age due to its advantages of free viewing angle limitation, low manufacturing cost, high response speed (approximately more than a hundred times of a liquid crystal display), power saving, self-luminescent, direct current driver that can be used for a portable machine, wide operating temperature range, light weight, and miniaturization and thinning according to a hardware device. Therefore, the AMOLED display device has great potential for development, and is expected to become a next generation of a new-model flat panel display so as to take the place of a liquid crystal display (LCD).

At present, an AMOLED display panel has mainly three modes of manufacturing. The first mode is to manufacture by utilizing amorphous silicon (a-Si) thin film transistor (TFT) process technology. The second mode is to manufacture by utilizing low temperature poly-silicon (LTPS) TFT process technology. The third mode is to manufacture by utilizing oxide TFT process technology. Herein, compared to other two modes, a-Si TFT does not have a relatively high electronic mobility, and its threshold voltage would produce shift under a long time of compression and high temperature, which would result in non-uniformity of the display panel. Generally, the a-Si TFT is applied on the LCD widely. However, the LTPS TFT process technology needs to adopt multi-channel mask manufacturing process, thereby resulting in an increase of cost. Therefore, the LTPS TFT process technology is mainly applicable to small and medium size panels currently, while the oxide TFT process technology is mainly applicable to a large-size AMOLED panel.

Generally, for an AMOLED display panel manufactured by adopting the oxide TFT process technology, types of TFTs in its pixel circuit can be divided into P-type or N-type. However, no matter a P-type TFT or an N-type TFT is selected to realize an organic light emitting diode (OLED) pixel circuit, a turn-on voltage (Voled_th) of the OLED would change under the effect of long time stress, while current flowing through the OLED would not only vary with the turn-on voltage (Voled_th) of the OLED, but also be different with threshold voltage shift (Vth shift) of TFT used for driving the OLED. As such, brightness uniformity and brightness constancy of the OLED display apparatus would be also influenced.

SUMMARY

There is provided in the present disclosure a pixel driving circuit and a driving method of the same and a display apparatus, which are used to raise brightness uniformity and brightness constancy of the display apparatus.

According to one aspect of the present disclosure, there is provided a pixel driving circuit, comprising: a main driving unit connected to a data line; a main light-emitting device connected to the main driving unit; an auxiliary driving unit connected to the main driving unit; and an auxiliary light-emitting device connected to the auxiliary driving unit, wherein in an acquisition phase, the main driving unit is configured to discharge through the main light-emitting device, and the auxiliary driving unit is configured to discharge through the main light-emitting device;

in a data storage phase, the main driving unit is configured to store a data voltage outputted by the data line; and in a light-emitting phase, the main driving unit is configured to drive the main light-emitting device to emit light, and the auxiliary driving unit is configured to drive the auxiliary light-emitting device to emit light.

Optionally, the main driving unit comprises: a first driving module, a first storage module and a first control module, the first driving module is connected to the first storage module, the first control module and the main light-emitting device respectively, and the first storage module is connected to the first control module;

In the acquisition phase, the first control module is turned on under the control of a first selection signal line to make the first storage module and the first driving module connected to the main light-emitting device, and when a data voltage stored in the first storage module is greater than a sum of a threshold voltage of the first driving module and a turn-on voltage of the main light-emitting device, the first storage module is discharged through the first driving module and the main light-emitting device;

in the data storage phase, the first control module is turned on under the control of a second selection signal line to connect the data line with the first storage module, so that the first storage module stores the data voltage;

in the light-emitting phase, the first control module is turned on under the control of a light-emitting control signal line to connect a power supply line with the first driving module, so that the first driving module drives the main light-emitting device to emit light through a power supply voltage outputted by the power supply line under the control of the data voltage outputted by the first storage module.

Optionally, the first driving module comprises a first switch transistor, the first storage module comprises a first capacitor, the first control module comprises a second switch transistor, a third switch transistor and a fourth switch transistor, and the main light-emitting device comprises a first organic light-emitting diode;

a control electrode of the first switch transistor is connected to a first node, a first electrode thereof is connected to a second node, and a third electrode thereof is connected to an anode of the first organic light-emitting diode;

a control electrode of the second switch transistor is connected to the second selection signal line, a first electrode thereof is connected to the data line, and a second electrode thereof is connected to a first node;

a control electrode of the third switch transistor is connected to the first selection signal line, a first electrode thereof is connected to the first node, and a second electrode thereof is connected to the second node;

a control electrode of the fourth switch transistor is connected to the light-emitting control signal line, a first electrode thereof is connected to the power supply line, and a second electrode thereof is connected to the second node;

a first terminal of the first capacitor is connected to the first node, and a second terminal thereof is connected to a reference power supply; and a cathode of the first organic light-emitting diode is connected to the reference power supply.

Optionally, the auxiliary driving unit comprises a second driving module, a second storage module and a second control module, the second driving module is connected to the second storage module and the auxiliary light-emitting device respectively, and the second storage module is connected to the second control module;

in the acquisition phase, the second control module is turned on under the control of the first selection line, to make the second storage module and the main driving unit connected to the main light-emitting device, and when a data voltage stored in the second storage module is greater than the sum of the threshold voltage of the first driving module and the turn-on voltage of the main light-emitting device, the second storage module is discharged through the main driving unit and the main light-emitting device;

In the light-emitting phase, when the data voltage stored in the second storage module is greater than a sum of a threshold voltage of the second driving module and a turn-on voltage of the auxiliary light-emitting device, the second driving module drives the auxiliary light-emitting device to emit light through a light-emitting signal outputted by the light-emitting control signal line under the control of a data voltage outputted by the second storage module.

Optionally, the second control module comprises a fifth switch transistor, the second driving module comprises a sixth switch transistor, the second storage module comprises a second capacitor, and the auxiliary light-emitting device comprises a second organic light-emitting diode;

a control electrode of the fifth switch transistor is connected to the first selection signal line, a first electrode thereof is connected to the second node, and a second electrode thereof is connected to a third node;

a control electrode of the sixth switch transistor is connected to the third node, a first electrode thereof is connected to the light-emitting control signal line, and a second electrode thereof is connected to an anode of the second organic light-emitting diode; and a cathode of the second organic light-emitting diode is connected to the reference power supply.

Optionally, in the acquisition phase, a gate voltage outputted by the first selection signal line is at a high level;

In the data storage phase, a gate voltage outputted by the second selection signal line is at a high level;

In the light-emitting phase, the light-emitting signal outputted by the light-emitting control signal line is at a high level.

Optionally, in the acquisition phase, the gate voltage outputted by the first selection signal line is at a high level;

In the light-emitting phase, the light-emitting signal outputted by the light-emitting control signal line is at a high level.

According to another aspect of the present disclosure, there is provided a display apparatus, comprising: the pixel driving circuit described above.

According to another aspect of the present disclosure, there is provided a driving method of a pixel driving circuit which comprises: a main driving unit, a main light-emitting device, an auxiliary driving unit and an auxiliary light-emitting device, the main driving unit is connected to the main light-emitting device, the auxiliary driving unit is connected to the auxiliary light-emitting device, and the main driving unit is connected to the auxiliary driving unit;

the driving method comprises:

in an acquisition phase, discharging the main driving unit through the main light-emitting device, and discharging the auxiliary driving unit through the main light-emitting device;

in a data storage phase, storing a data voltage in the main driving unit; and in a light-emitting phase, driving the main light-emitting device to emit light by the main driving unit, and driving the auxiliary light-emitting device to emit light by the auxiliary driving unit.

Optionally, the auxiliary driving unit comprises: a second driving module, a second storage module and a second control module, the second driving module is connected to the second storage module and the auxiliary light-emitting device respectively, and the second storage module is connected to the second control module;

driving, the auxiliary light-emitting device to emit light by the auxiliary driving unit comprises:

when a data voltage of the second control module stored in the second storage module is greater than a sum of a threshold voltage of the second driving module and a turn-on voltage of the auxiliary light-emitting device, driving the auxiliary light-emitting device to emit light through a light-emitting signal outputted by a light-emitting control signal line under the control of the data voltage outputted by the second storage module by means of the second driving module.

In technical solutions of the pixel driving circuit and the driving method of the same and the display apparatus provided in the present disclosure, the pixel driving circuit comprises the main driving unit, the main light-emitting device, the auxiliary driving unit and the auxiliary light-emitting device. In the light-emitting phase, the auxiliary driving unit can drive the auxiliary light-emitting device to emit light, which compensates for brightness loss of the main light-emitting device, so that brightness uniformity and brightness constancy of the display apparatus are raised.

DETAILED DESCRIPTION

In order to make those skilled in the art understand the technical solution of the present disclosure to the better, a pixel driving circuit and a driving method of the same and a display apparatus provided in the present disclosure will be described below in detail by combining with figures.

Figure 1:
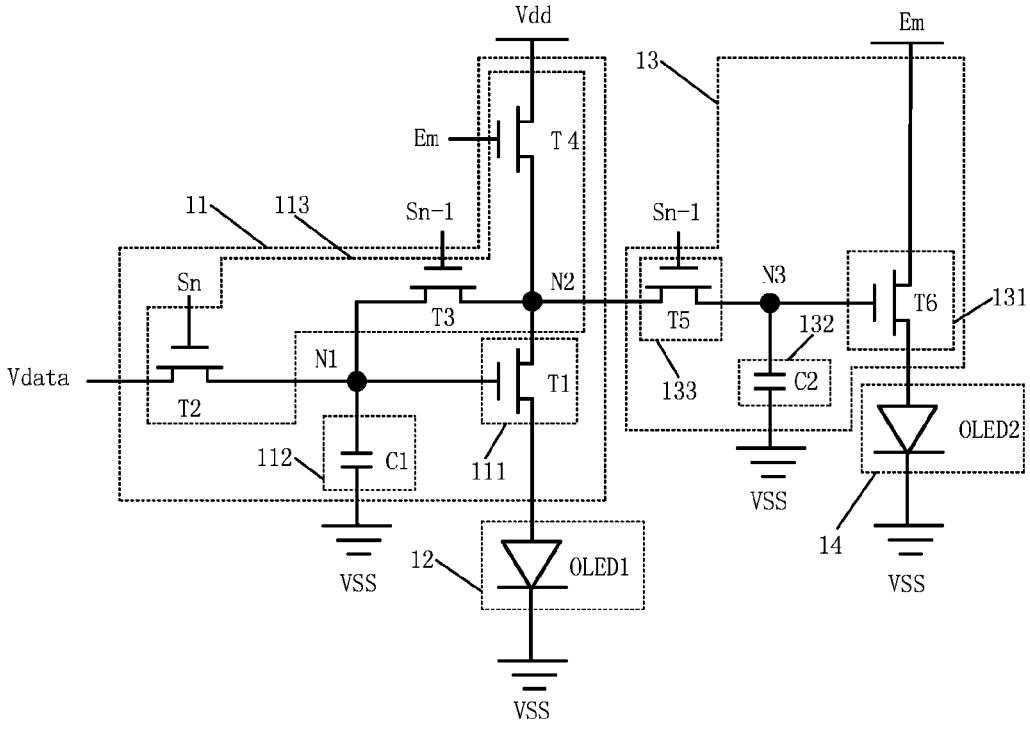
FIG. 1 is a schematic diagram of a structure of a pixel driving circuit provided in one embodiment of the present disclosure.

FIG. 1 shows a schematic diagram of a structure of a pixel driving circuit provided in an exemplary embodiment of the present disclosure. As shown in FIG. 1, the pixel driving circuit comprises: a main driving unit 11, a main light-emitting device 12, an auxiliary driving unit 13 and an auxiliary light-emitting device 14. The main driving unit 11 is connected to the main light-emitting device 12, the auxiliary driving unit 13 is connected to the auxiliary light-emitting unit 14, and the main driving unit 11 is connected to the auxiliary driving unit 13.

In an acquisition phase, the main driving unit 11 is configured to discharge through the main light-emitting device 12, and the auxiliary driving unit 13 is configured to discharge through the auxiliary light-emitting device 14.

In a data storage phase, the main driving unit 11 is configured to store a data voltage.

In a light-emitting phase, the main driving unit 11 is configured to drive the main light-emitting device 12 to emit light, and the auxiliary driving unit 13 is configured to drive the auxiliary light-emitting device 14 to emit light. In particular, the auxiliary driving unit 13 can drive the auxiliary light-emitting device 14 to emit light when brightness of the main light-emitting device 12 is attenuated, so that brightness loss of the main light-emitting device 12 is remedied.

In the embodiment as shown in FIG. 1, the main driving unit 11 comprises: a first driving module 111, a first storage module 112 and a first control module 113. The first driving module 111 is connected to the first storage module 112, the first control module 113 and the main light-emitting device 12 respectively, and the first storage module 112 is connected to the first control module 113. In the acquisition phase, the first control module 113 is turned on under the control of a first selection signal line Sn-1, to make the first storage module 112 and the first driving module 111 connected to the main light-emitting device 12. When the data voltage stored in the first storage module 112 is greater than a sum of a threshold voltage of the first driving module 111 and a turn-on voltage of the main light-emitting device 12, the first storage module 112 discharges through the first driving module 111 and the main light-emitting device 12. In the data storage phase, the first control module 113 is turned on under the control of a second selection signal line Sn, to connect a data line Vdata with the first storage module 112, so that the first storage module 112 stores the data voltage outputted by the data line Vdata. In the light-emitting phase, the first control module 113 is turned on under the control of a light-emitting control signal line Em, to connect a power supply line Vdd with the first driving module 111, so that the first driving module 111 drives the main light-emitting device 12 to emit light through a power supply voltage outputted by the power supply line Vdd under the control of the data voltage outputted by the first storage module 112. In the present embodiment, the first selection signal line Sn-1 is a scanning line of a previous row of the second selection signal line Sn.

Exemplarily, the first driving module 111 comprises a first switch transistor T1, the first storage module 112 comprises a first capacitor C1, the first control module 113 comprises a second switch transistor T2, a third switch transistor T3 and a fourth switch transistor T4, and the main light-emitting device 12 comprises a first organic light-emitting diode OLED1. As shown in FIG. 1, a control electrode of the first switch transistor T1 is connected to a first node N1, a first electrode thereof is connected to a second node N2, and a third electrode thereof is connected to an anode of the OLED1. A control electrode of the second switch transistor T2 is connected to the second selection signal line Sn, a first electrode thereof is connected to the data line Vdata, and a second electrode thereof is connected to the first node N1; a control electrode of the third switch transistor T3 is connected to the first selection signal line Sn-1, a first electrode thereof is connected to the first node N1, and a second electrode thereof is connected to the second node N2; a control electrode of the fourth switch transistor T4 is connected to the light-emitting control signal line Em, a first electrode thereof is connected to the power supply line Vdd, and a second electrode thereof is connected to the second node N2; a first terminal of the first capacitor C1 is connected to the first node N1, and a second terminal thereof is connected to a reference power supply Vss; a cathode of the OLED1 is connected to the reference power supply Vss. In the present embodiment, exemplarily, a reference voltage outputted by the reference power supply Vss is a ground voltage.

In the embodiment as shown in FIG. 1, the auxiliary driving unit 13 comprises: a second driving module 131, a second storage module 132 and a second control module 133. The second driving module 131 is connected to the second storage module 132 and the auxiliary light-emitting device 14 respectively, and the second storage module 132 is connected to the second control module 133. In the acquisition phase, the second control module 133 is turned on under the control of the first selection signal line Sn-1, to make the second storage module 132 and the main driving unit 11 connected to the main light-emitting device 12, and when the data voltage stored in the second storage module 132 is greater than the sum of the threshold voltage of the first driving module 111 and the turn-on voltage of the main light-emitting device 12, the second storage module 132 discharges through the main driving unit 11 and the main light-emitting device 12; in the light-emitting phase, when the data voltage of the second storage module 132 is greater than a sum of a threshold voltage of the second driving module 131 and a turn-on voltage of the auxiliary light-emitting device 14, the second driving module 131 drives the auxiliary light-emitting device 14 to emit light through a light-emitting signal outputted by the light-emitting control signal line Em under the control of a data voltage outputted by the second storage module 132.

Exemplarily, the second control module 133 comprises a fifth switch transistor T5, the second driving module 131 comprises a sixth switch transistor T6, the second storage module 132 comprises a second capacitor C2, and the auxiliary light-emitting device 14 comprises a second organic light-emitting device OLED2. A control electrode of the fifth switch transistor T5 is connected to the first selection signal line Sn-1, a first electrode thereof is connected to the second node N2, and a second electrode thereof is connected to a third node N3. A control electrode of the sixth switch transistor T6 is connected to the third node N3, a first electrode thereof is connected to the light-emitting control signal line Em, and a second electrode thereof is connected to an anode of the OLED2; a cathode of the OLED2 is connected to the reference power supply Vss.

Figure 2:
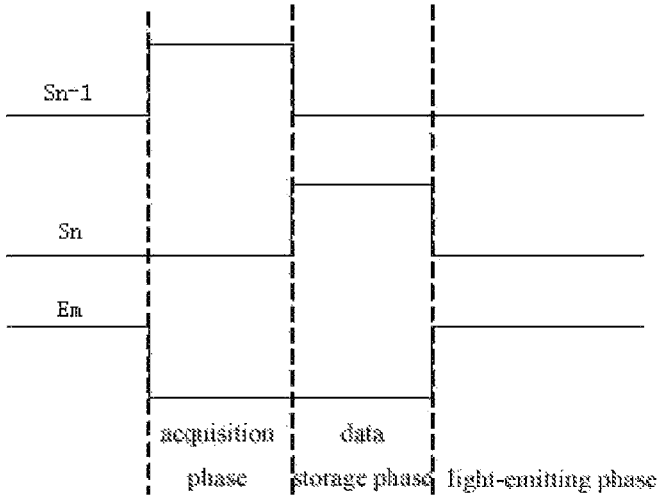
FIG. 2 is a signal timing diagram of the pixel driving circuit as shown in FIG. 1.

Operating process of the pixel driving circuit provided in the present embodiment will be described below in detail by referring to FIGS. 2-5. Herein, FIG. 2 is a signal timing diagram of the pixel driving circuit as shown in FIG. 1.

Figure 3:
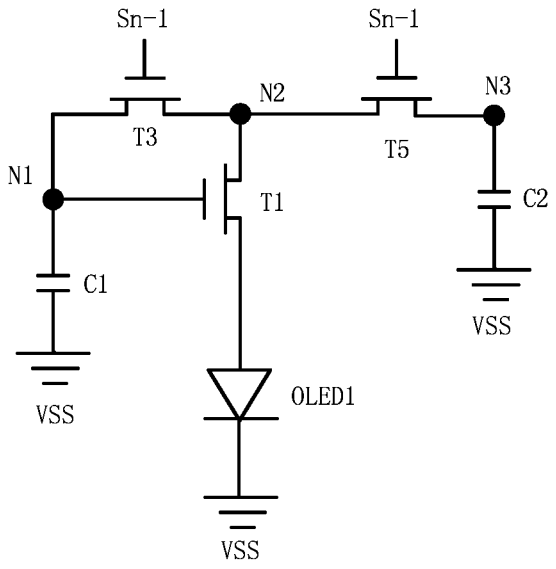
FIG. 3 is a schematic diagram of an equivalent circuit of the pixel driving circuit as shown in FIG. 1 in an acquisition phase.

FIG. 3 is a schematic diagram of an equivalent circuit of the pixel driving circuit as shown in FIG. 1 in an acquisition phase. As shown in FIGS. 2 and 3, in the acquisition phase, the third switch transistor T3 is turned on under the control of a gate voltage outputted by the first selection signal line Sn-1. Now, the gate voltage outputted by the first selection signal line Sn-1 is at a high level. The second switch transistor T2 is turned off under the control of a gate voltage outputted by the second selection signal line Sn. Now, the gate voltage outputted by the second selection signal line Sn is at a low level. The fourth switch transistor T4 is turned off under the control of the light-emitting signal outputted by the light-emitting control signal line Em. Now, the light-emitting signal outputted by the light-emitting control signal line Em is at the low level. The fifth switch transistor T5 is turned on under the control of the gate voltage outputted by the first selection signal line Sn-1. Now, the gate voltage outputted by the first selection signal line Sn-1 is at the high level. After a picture of a previous frame is displayed, the data voltage of the previous frame is stored in the first capacitor C1, and the data voltage of the previous frame is stored in the second capacitor C2. The third switch transistor T3 is turned on to make the first capacitor C1 and the first switch transistor T1 connected to the OLED1. Since the data voltage of the previous frame stored in the first capacitor C1 is greater than the sum of the threshold voltage of the first switch transistor T1 and the turn-on voltage of the OLED1, the first capacitor C1 can be discharged through the first switch transistor T1 and the OLED1 until the voltage of the first capacitor C1 is the sum of the threshold voltage of the first switch transistor T1 and the turn-on voltage of the OLED1, i.e., the sum of the threshold voltage of the first switch transistor T1 and the turn-on voltage of the OLED1 is stored in the first capacitor C1. The fifth switch transistor T5 is turned on to make the second capacitor C2 and the first switch transistor T1 connected to the OLED1. Since the data voltage of the previous frame stored in the second capacitor C2 is greater than the sum of the threshold voltage of the first switch transistor T1 and the turn-on voltage of the OLED1, the second capacitor C2 can be discharged through the first switch transistor T1 and the OLED1 until the voltage of the second capacitor C2 is the sum of the threshold voltage of the first switch transistor T1 and the turn-on voltage of the OLED1, i.e., the sum of the threshold voltage of the first switch transistor T1 and the turn-on voltage of the OLED1 is stored in the second capacitor C2.

Figure 4:
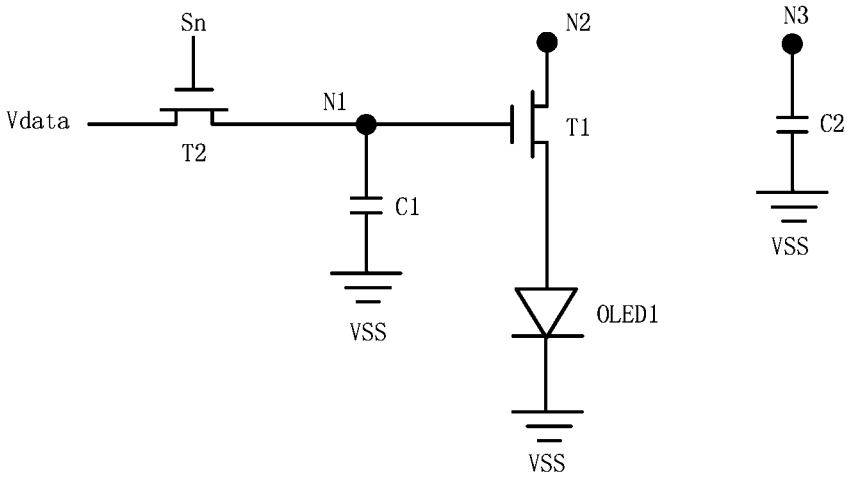
FIG. 4 is a schematic diagram of an equivalent circuit of the pixel driving circuit as shown in FIG. 1 in a data storage phase.

FIG. 4 is a schematic diagram of an equivalent circuit of the pixel driving circuit as shown in FIG. 1 in the data storage phase. As shown in FIGS. 2 and 4, in the data storage phase, the second switch transistor T2 is turned on under the control of a gate voltage outputted by the second selection signal line Sn. Now, the gate voltage outputted by the second selection signal line Sn is at the high level. The third switch transistor T3 is turned off under the control of the gate voltage outputted by the first selection signal line Sn-1. Now, the gate voltage outputted by the first selection signal line Sn-1 is at the low level. The fourth switch transistor T4 is turned off under the control of the light-emitting signal outputted by the light-emitting control signal line Em. Now, the light-emitting signal outputted by the light-emitting control signal line Em is at the low level. The fifth switch transistor T5 is turned off under the control of the gate voltage outputted by the first selection signal line Sn-1. Now, the gate voltage outputted by the first selection signal line Sn-1 is at the low level. The second switch transistor T2 is turned on to connect the data line Vdata with the first capacitor C1, and the data line Vdata outputs the data voltage and writes the data voltage into the first capacitor C1, so that the first capacitor C1 stores the data voltage outputted by the data line Vdata. The data voltage is a data voltage of a current frame. The voltage of the second capacitor C2 is maintained unchanged, i.e., the voltage of the second capacitor C2 is the sum of the threshold voltage of the first switch transistor T1 and the turn-on voltage of the OLED1.

Figure 5:
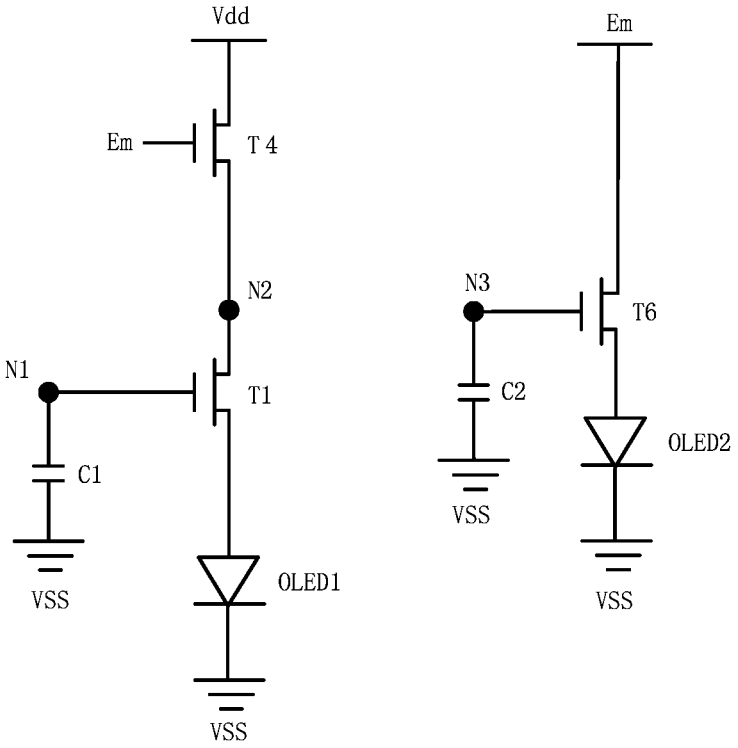
FIG. 5 is a schematic diagram of an equivalent circuit of the pixel driving circuit as shown in FIG. 1 in a light-emitting phase.

FIG. 5 is a schematic diagram of an equivalent circuit of the pixel driving circuit as shown in FIG. 1 in the light-emitting phase. As shown in FIGS. 2 and 5, in the light-emitting phase, the second switch transistor T2 is turned off under the control of the gate voltage outputted by the second selection signal line Sn. Now, the gate voltage outputted by the second selection signal line Sn is at the low level. The third switch transistor T3 is turned off under the control of the gate voltage outputted by the first selection signal line Sn-1. Now, the gate voltage outputted by the first selection signal line Sn-1 is at the low level. The fourth switch transistor T4 is turned on under the control of the light-emitting signal outputted by the light-emitting control signal line Em. Now, the light-emitting signal outputted by the light-emitting control signal line Em is at the high level. The fifth switch transistor T5 is turned off under the control of the gate voltage outputted by the first selection signal line Sn-1. Now, the gate voltage outputted by the first selection signal line Sn-1 is at the low level. The fourth switch transistor T4 is turned on, to connect the power supply line Vdd with the first switch transistor T1, and under the control of a voltage (i.e., the data voltage outputted by the first capacitor C1) of the first node N1 connected to one terminal of the first capacitor C1, the first switch transistor T1 drives the OLED1 to emit light through the power supply voltage outputted by the power supply line Vdd. In the process of displaying frame by frame by the display apparatus, the shift and continuous aging of the threshold voltage of the first switch transistor T1 would result in rising of the threshold voltage of the first switch transistor T1; the shift and continuous aging of the turn-on voltage of the OLED1 would result in rising of the turn-on voltage of the OLED1. When the threshold voltage of the first switch transistor T1 and the turn-on voltage of the OLED1 rise, in the above acquisition phase, the data voltage stored in the second capacitor C2 would increase constantly. When the data voltage stored in the second capacitor C2 is greater than the sum of the threshold voltage of the sixth switch transistor T6 and the turn-on voltage of the OLED2, it indicates the shift or continuous aging of the threshold voltage of the first switch transistor and the turn-on voltage of the OLED1, thereby resulting in that brightness attenuation occurs to the OLED1. Under the control of a voltage (i.e., the data voltage outputted by the second capacitor C2) of the third node N3 connected to one terminal of the second capacitor C2, the sixth switch transistor T6 drives the OLED2 to emit light through the light-emitting signal outputted by the light-emitting control signal line Em, so as to compensate for brightness loss of the OLED1. Since in an initial phase of displaying a picture by the display apparatus, the sixth switch transistor T6 and OLED2 do not need to compensate for the brightness attenuation of the OLED1. Therefore, exemplarily, the threshold voltage of the sixth switch transistor T6 may be greater than the threshold voltage of the first switch transistor T1, thereby ensuring that the brightness attenuation of the OLED1 starts to be compensated for by the sixth switch transistor T6 and the OLED2 only after the threshold voltage of the first switch transistor T1 has raised.

Exemplarily, respective switch transistors can be TFTs.

The pixel driving circuit provided in the present embodiment comprises the main driving unit, the main light-emitting device, the auxiliary driving unit and the auxiliary light-emitting device. In the light-emitting phase, the auxiliary driving unit can drive the auxiliary light-emitting device to emit light, which compensates for brightness loss of the main light-emitting device, so that brightness uniformity and brightness constancy of the display apparatus are raised.

There is provided in another embodiment of the present disclosure a display apparatus, comprising: a pixel driving circuit. This pixel driving circuit can adopt the pixel driving circuit provided in the first embodiment, and thus no further description is given herein.

Exemplarily, the display apparatus comprises an AMOLED display apparatus.

In the display apparatus provided in the present embodiment, the pixel driving circuit comprises the main driving unit, the main light-emitting device, the auxiliary driving unit and the auxiliary light-emitting device. In the light-emitting phase, the auxiliary driving unit can drive the auxiliary light-emitting device to emit light, which compensates for brightness loss of the main light-emitting device, so that brightness uniformity and brightness constancy of the display apparatus are raised.

There is provided in another embodiment of the present disclosure a driving method of a pixel driving circuit. The pixel driving circuit comprises: a main driving unit, a main light-emitting device, an auxiliary driving unit and an auxiliary light-emitting device, wherein the main driving unit is connected to the main light-emitting device, the auxiliary driving unit is connected to the auxiliary light-emitting device, and the main driving unit is connected to the auxiliary driving unit;

The driving method comprises:

in an acquisition phase, the main driving unit discharges through the main light-emitting device, and the auxiliary driving unit discharges through the main light-emitting device;

in a data storage phase, the main driving unit stores a data voltage; and in a light-emitting phase, the main driving unit drives the main light-emitting device to emit light, and the auxiliary driving unit drives the auxiliary light-emitting device to emit light.

Herein, the auxiliary driving unit comprises: a second driving module, a second storage module and a second control module, wherein the second driving module is connected to the second storage module and the auxiliary light-emitting device respectively, and the second storage module is connected to the second control module. In this case, driving, by the auxiliary driving unit, the auxiliary light-emitting device to emit light comprises:

when a data voltage stored in the second storage module is greater than a sum of a threshold voltage of the second driving module and a turn-on voltage of the auxiliary light-emitting device, the second driving module drives the auxiliary light-emitting device to emit light under the control of the data voltage outputted by the second storage module through a light-emitting signal outputted by a light-emitting control signal line.

In the driving method of the pixel driving circuit provided in the present embodiment, the pixel driving circuit comprises the main driving unit, the main light-emitting device, the auxiliary driving unit and the auxiliary light-emitting device. In the light-emitting phase, the auxiliary driving unit can drive the auxiliary light-emitting device to emit light, which compensates for brightness loss of the main light-emitting device, so that brightness uniformity and brightness constancy of the display apparatus are raised.

It can be understood that the above implementations are just exemplary implementations adopted to describe principle of the present disclosure. However, the present disclosure is not limited thereto. For those ordinary skilled in the art, various modifications and improvements can be made without departing from the spirit and essence of the present disclosure. These modifications and improvements can also be deemed as the protection scope of the present disclosure.

The present application claims the priority of a Chinese patent application No. 201510185647.0 filed on Apr. 17, 2015. Herein, the content disclosed by the Chinese patent application is incorporated in full by reference as a part of the present disclosure.

What is claimed is:

1. A pixel driving circuit, comprising:

a main driving unit connected to a data line;

a main light-emitting device connected to the main driving unit;

an auxiliary driving unit connected to the main driving unit; and an auxiliary light-emitting device connected to the auxiliary driving unit, wherein in an acquisition phase, the main driving unit is configured to be discharged through the main light-emitting device, and the auxiliary driving unit is configured to be discharged through the main light-emitting device;

in a data storage phase, the main driving unit is configured to store a data voltage inputted by the data line; and in a light-emitting phase, the main driving unit is configured to drive the main light-emitting device to emit light, and the auxiliary driving unit is configured to drive the auxiliary light-emitting device to emit light; and wherein the main driving unit comprises a first driving module and a first control module, the first driving module comprising a first switch transistor, and the first control module comprising a second switch transistor, wherein a first electrode of the first switch transistor is connected to the main light-emitting device, a first electrode of the second switch transistor is connected to the data line, and a control electrode of the first switch transistor is connected directly to a second electrode of the second switch transistor.

2. The pixel driving circuit according to claim 1, wherein the main driving unit further comprises a first storage module, the first driving module is connected to the first storage module, the first control module and the main light-emitting device, respectively, and the first storage module is connected to the first control module;

in the acquisition phase, the first control module is turned on under the control of a first selection signal line to make the first storage module and the first driving module connected to the main light-emitting device, and when a data voltage stored in the first storage module is greater than a sum of a threshold voltage of the first driving module and a turn-on voltage of the main light-emitting device, the first storage module is discharged through the first driving module and the main light-emitting device;

in the data storage phase, the first control module is turned on under the control of a second selection signal line to connect the data line with the first storage module, so that the first storage module stores the data voltage; and in the light-emitting phase, the first control module is turned on under the control of a light-emitting control signal line to connect a power supply line with the first driving module, so that the first driving module drives the main light-emitting device to emit light through a power supply voltage inputted by the power supply line under the control of the data voltage outputted by the first storage module.

3. The pixel driving circuit according to claim 2, wherein the first storage module comprises a first capacitor, the first control module further comprises a third switch transistor and a fourth switch transistor, and the main light-emitting device comprises a first organic light-emitting diode;

the control electrode of the first switch transistor is connected to a first node, a second electrode thereof is connected to a second node, and the first electrode thereof is connected to an anode of the first organic light-emitting diode;

a control electrode of the second switch transistor is connected to the second selection signal line, and the second electrode thereof is connected to the first node;

a control electrode of the third switch transistor is connected to the first selection signal line, a first electrode thereof is connected to the first node, and a second electrode thereof is connected to the second node;

a control electrode of the fourth switch transistor is connected to the light-emitting control signal line, a first electrode thereof is connected to the power supply line, and a second electrode thereof is connected to the second node;

a first terminal of the first capacitor is connected to the first node, and a second terminal thereof is connected to a reference power supply; and a cathode of the first organic light-emitting diode is connected to the reference power supply.

4. The pixel driving circuit according to claim 3, wherein the auxiliary driving unit comprises a second driving module, a second storage module and a second control module, the second driving module is connected to the second storage module and the auxiliary light-emitting device respectively, and the second storage module is connected to the second control module;

in the acquisition phase, the second control module is turned on under the control of the first selection signal line, to make the second storage module and the main driving unit connected to the main light-emitting device, and when a data voltage stored in the second storage module is greater than the sum of the threshold voltage of the first driving module and the turn-on voltage of the main light-emitting device, the second storage module is discharged through the main driving unit and the main light-emitting device;

in the light-emitting phase, when the data voltage stored in the second storage module is greater than a sum of a threshold voltage of the second driving module and an turn-on voltage of the auxiliary light-emitting device, the second driving module drives the auxiliary light-emitting device to emit light through a light-emitting signal inputted by the light-emitting control signal line under the control of a data voltage outputted by the second storage module.

5. The pixel driving circuit according to claim 4, wherein the second control module comprises a fifth switch transistor, the second driving module comprises a sixth switch transistor, the second storage module comprises a second capacitor, and the auxiliary light-emitting device comprises a second organic light-emitting diode;

a control electrode of the fifth switch transistor is connected to the first selection signal line, a first electrode thereof is connected to the second node, and a second electrode thereof is connected to a third node;

a control electrode of the sixth switch transistor is connected to the third node, a first electrode thereof is connected to the light-emitting control signal line, and a second electrode thereof is connected to an anode of the second organic light-emitting diode; and a cathode of the second organic light-emitting diode is connected to the reference power supply.

6. The pixel driving circuit according to claim 2, wherein in the acquisition phase, a gate voltage inputted by the first selection signal line is at a high level;

in the data storage phase, a gate voltage inputted by the second selection signal line is at a high level; and in the light-emitting phase, a light-emitting signal inputted by the light-emitting control signal line is at a high level.

7. The pixel driving circuit according to claim 2, wherein the auxiliary driving unit comprises a second driving module, a second storage module and a second control module, the second driving module is connected to the second storage module and the auxiliary light-emitting device respectively, and the second storage module is connected to the second control module;

in the acquisition phase, the second control module is turned on under the control of the first selection signal line, to make the second storage module and the main driving unit connected to the main light-emitting device, and when a data voltage stored in the second storage module is greater than the sum of the threshold voltage of the first driving module and the turn-on voltage of the main light-emitting device, the second storage module is discharged through the main driving unit and the main light-emitting device;

in the light-emitting phase, when the data voltage stored in the second storage module is greater than a sum of a threshold voltage of the second driving module and an turn-on voltage of the auxiliary light-emitting device, the second driving module drives the auxiliary light-emitting device to emit light through a light-emitting signal inputted by the light-emitting control signal line under the control of a data voltage outputted by the second storage module.

8. The pixel driving circuit according to claim 1, wherein the auxiliary driving unit comprises a second driving module, a second storage module and a second control module, the second driving module is connected to the second storage module and the auxiliary light-emitting device respectively, and the second storage module is connected to the second control module;

in the acquisition phase, the second control module is turned on under the control of the first selection signal line, to make the second storage module and the main driving unit connected to the main light-emitting device, and when a data voltage stored in the second storage module is greater than the sum of the threshold voltage of the first driving module and the turn-on voltage of the main light-emitting device, the second storage module is discharged through the main driving unit and the main light-emitting device;

in the light-emitting phase, when the data voltage stored in the second storage module is greater than a sum of a threshold voltage of the second driving module and an turn-on voltage of the auxiliary light-emitting device, the second driving module drives the auxiliary light-emitting device to emit light through a light-emitting signal inputted by the light-emitting control signal line under the control of a data voltage outputted by the second storage module.

9. The pixel driving circuit according to claim 8, wherein the second control module comprises a fifth switch transistor, the second driving module comprises a sixth switch transistor, the second storage module comprises a second capacitor, and the auxiliary light-emitting device comprises a second organic light-emitting diode;

a control electrode of the fifth switch transistor is connected to the first selection signal line, a first electrode thereof is connected to the second node, and a second electrode thereof is connected to a third node;

a control electrode of the sixth switch transistor is connected to the third node, a first electrode thereof is connected to the light-emitting control signal line, and a second electrode thereof is connected to an anode of the second organic light-emitting diode; and a cathode of the second organic light-emitting diode is connected to the reference power supply.

10. The pixel driving circuit according to claim 8, wherein in the acquisition phase, the gate voltage inputted by the first selection signal line is at a high level;

in the light-emitting phase, the light-emitting signal inputted by the light-emitting control signal line is at a high level.

11. A display apparatus, comprising: the pixel driving circuit according to claim 1.

12. The display apparatus according to claim 11, wherein the main driving unit further comprises a first storage module, the first driving module is connected to the first storage module, the first control module and the main light-emitting device, respectively, and the first storage module is connected to the first control module;

in the acquisition phase, the first control module is turned on under the control of a first selection signal line to make the first storage module and the first driving module connected to the main light-emitting device, and when a data voltage stored in the first storage module is greater than a sum of a threshold voltage of the first driving module and a turn-on voltage of the main light-emitting device, the first storage module is discharged through the first driving module and the main light-emitting device;

in the data storage phase, the first control module is turned on under the control of a second selection signal line to connect the data line with the first storage module, so that the first storage module stores the data voltage; and in the light-emitting phase, the first control module is turned on under the control of a light-emitting control signal line to connect a power supply line with the first driving module, so that the first driving module drives the main light-emitting device to emit light through a power supply voltage inputted by the power supply line under the control of the data voltage outputted by the first storage module.

13. The display apparatus according to claim 12, wherein the first storage module comprises a first capacitor, the first control module further comprises a third switch transistor and a fourth switch transistor, and the main light-emitting device comprises a first organic light-emitting diode;

the control electrode of the first switch transistor is connected to a first node, a second electrode thereof is connected to a second node, and the first electrode thereof is connected to an anode of the first organic light-emitting diode;

a control electrode of the second switch transistor is connected to the second selection signal line, and the second electrode thereof is connected to a first node;

a control electrode of the third switch transistor is connected to the first selection signal line, a first electrode thereof is connected to the first node, and a second electrode thereof is connected to the second node;

a control electrode of the fourth switch transistor is connected to the light-emitting control signal line, a first electrode thereof is connected to the power supply line, and a second electrode thereof is connected to the second node;

a first terminal of the first capacitor is connected to the first node, and a second terminal thereof is connected to a reference power supply; and a cathode of the first organic light-emitting diode is connected to the reference power supply.

14. The display apparatus according to claim 12, wherein in the acquisition phase, a gate voltage inputted by the first selection signal line is at a high level;

in the data storage phase, a gate voltage inputted by the second selection signal line is at a high level; and in the light-emitting phase, a light-emitting signal inputted by the light-emitting control signal line is at a high level.

15. The display apparatus according to claim 11, wherein the auxiliary driving unit comprises a second driving module, a second storage module and a second control module, the second driving module is connected to the second storage module and the auxiliary light-emitting device respectively, and the second storage module is connected to the second control module;

in the acquisition phase, the second control module is turned on under the control of the first selection signal line, to make the second storage module and the main driving unit connected to the main light-emitting device, and when a data voltage stored in the second storage module is greater than the sum of the threshold voltage of the first driving module and the turn-on voltage of the main light-emitting device, the second storage module is discharged through the main driving unit and the main light-emitting device;

in the light-emitting phase, when the data voltage stored in the second storage module is greater than a sum of a threshold voltage of the second driving module and an turn-on voltage of the auxiliary light-emitting device, the second driving module drives the auxiliary light-emitting device to emit light through a light-emitting signal inputted by the light-emitting control signal line under the control of a data voltage outputted by the second storage module.

16. The display apparatus according to claim 15, wherein the second control module comprises a fifth switch transistor, the second driving module comprises a sixth switch transistor, the second storage module comprises a second capacitor, and the auxiliary light-emitting device comprises a second organic light-emitting diode;

a control electrode of the fifth switch transistor is connected to the first selection signal line, a first electrode thereof is connected to the second node, and a second electrode thereof is connected to a third node;

a control electrode of the sixth switch transistor is connected to the third node, a first electrode thereof is connected to the light-emitting control signal line, and a second electrode thereof is connected to an anode of the second organic light-emitting diode; and a cathode of the second organic light-emitting diode is connected to the reference power supply.

17. The display apparatus according to claim 15, wherein in the acquisition phase, the gate voltage inputted by the first selection signal line is at a high level;

in the light-emitting phase, the light-emitting signal inputted by the light-emitting control signal line is at a high level.

18. A driving method of a pixel driving circuit according to claim 1, comprising:

in an acquisition phase, discharging the main driving unit through the main light-emitting device, and discharging the auxiliary driving unit through the main light-emitting device;

in a data storage phase, storing a data voltage in the main driving unit; and in a light-emitting phase, driving the main light-emitting device to emit light by the main driving unit, and driving the auxiliary light-emitting device to emit light by the auxiliary driving unit.

19. The driving method of the pixel driving circuit according to claim 18, wherein the auxiliary driving unit comprises: a second driving module, a second storage module and a second control module, the second driving module is connected to the second storage module and the auxiliary light-emitting device respectively, and the second storage module is connected to the second control module;

driving the auxiliary light-emitting device to emit light by the auxiliary driving unit comprises:

when a data voltage stored in the second storage module is greater than a sum of a threshold voltage of the second driving module and a turn-on voltage of the auxiliary light-emitting device, driving the auxiliary light-emitting device to emit light through a light-emitting signal inputted by a light-emitting control signal line under the control of the data voltage outputted by the second storage module by means of the second driving module.

* * * * *